United States Patent [19]

Sells

[11] Patent Number: 4,544,159

[45] Date of Patent: Oct. 1, 1985

[54] GOLFING AID

[76] Inventor: Paul S. Sells, 719 Shady Dr., Chattanooga, Tenn. 37412

[21] Appl. No.: 479,032

[22] Filed: Mar. 25, 1983

[51] Int. Cl.[4] ..... A63B 69/36

[52] U.S. Cl. ..... 273/183 A; 273/202

[58] Field of Search ..... 273/208, 183 A, 206, 273/202, 203, 33, 195 R

[56] References Cited

U.S. PATENT DOCUMENTS

| | | | |
|---|---|---|---|
| 1,650,141 | 11/1927 | Lowell | 273/208 |
| 3,580,584 | 5/1971 | Trosko | 273/208 |
| 4,106,772 | 8/1978 | Krawagna | 273/183 A |

FOREIGN PATENT DOCUMENTS

| | | | |
|---|---|---|---|
| 170476 | 10/1921 | United Kingdom | 273/202 |
| 368568 | 3/1932 | United Kingdom | 273/208 |
| 519193 | 3/1940 | United Kingdom | 273/208 |

*Primary Examiner*—George J. Marlo

*Attorney, Agent, or Firm*—Harvey B. Jacobson; Clarence A. O#Brien

[57] ABSTRACT

A golfing aid comprises a cup-like tee member for supporting a golf ball above a playing surface, and lengths of cord extending from the tee member. The lengths of cord may be laid along the playing surface in extended relation from the tee member to provide guides for a user, for such purposes as clubhead swing guidance, body alignment guidance, or ball positioning guidance.

1 Claim, 5 Drawing Figures

GOLFING AID

BACKGROUND OF THE INVENTION

Factors contributing towards efficient striking of a golf ball include, inter alia, proper body alignment in relation to the intended line of flight of the ball, proper ball positioning in relation to the golfer's feet, and maintenance of an effective clubhead swing path related to the intended line of flight.

The present invention provides a compact, readily transportable golfing aid incorporating a golf ball tee member and guide means integrated therewith for assisting a golfer in achieving one or more of the following criteria, namely effective alignment, ball positioning and swing path guidance.

DESCRIPTION OF PRIOR ART

Applicant is aware of the following U.S. Pat. Nos. showing different forms of golf ball tee constructions.

U.S. Pat. No. 1,554,321 Banigan 9-1925.
U.S. Pat. No. 1,599,310 Wiley 9-1926.
U.S. Pat. No. 1,783,211 Baldwin 12-1930.
U.S. Pat. No. 1,815,520 McLeod 7-1931.

SUMMARY OF THE INVENTION

Broadly stated, the invention provides a golfing aid comprising a tee member for supporting a golf ball above a playing surface on which the tee member is positioned, and elongate guide means associated with the tee member for laying along the playing surface in extended relation from the tee member and in predetermined orientation relative to a proposed line of flight of the ball for providing at least one guide in a group comprising a swing path guide, an alignment guide, and a ball position guide.

In one form of the invention, for example, the guide means may conveniently comprise lengths of cord which can be extended from the tee member in varying orientations. The lengths may include one or more of the following, namely a rearwardly extended length for guiding a golfer's clubhead path during the backswing and downswing; a forwardly extended length for guiding the clubhead on the follow-through; an inwardly extended length (extending from the ball toward the golfer) for assisting in ball positioning relative to the golfer's feet, and an outwardly extended length for assisting in body alignment. Where the aid has means providing all four of the above-noted cord lengths, these generally may be laid in orthogonal cruciform relation to the tee member, but the angularity between the lengths may be adjusted to suit a particular golfer's needs.

The tee member may be of an inverted cup-like form with an upper ball-supporting opening, and the cord lengths may be provided by two separate cords wound through respective pairs of openings formed around the cup-like member, the cords being wound in pull-through manner providing the facility for length adjustment of the respective cord lengths. Additionally, instead of the upper opening in the cup-like member forming the ball support, a tube may extend through this opening to provide an adjustable-height ball support.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Figure 1:
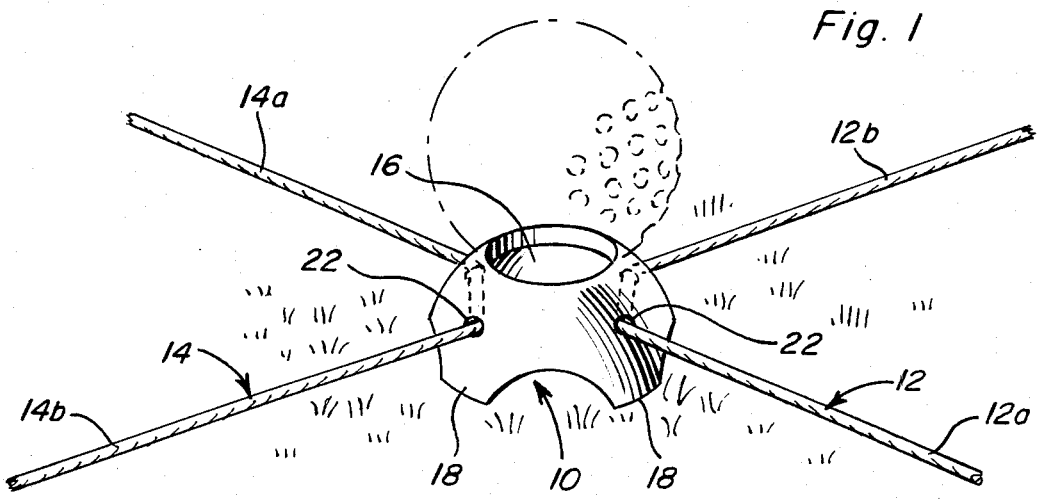
FIG. 1 is a perspective view of a golfing aid in accordance with the invention.
Figure 2:
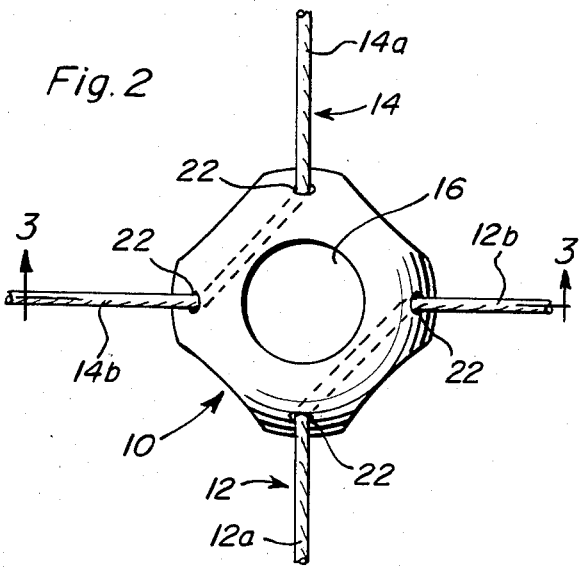
FIG. 2 is a plan view of the golfing aid.
Figure 3:
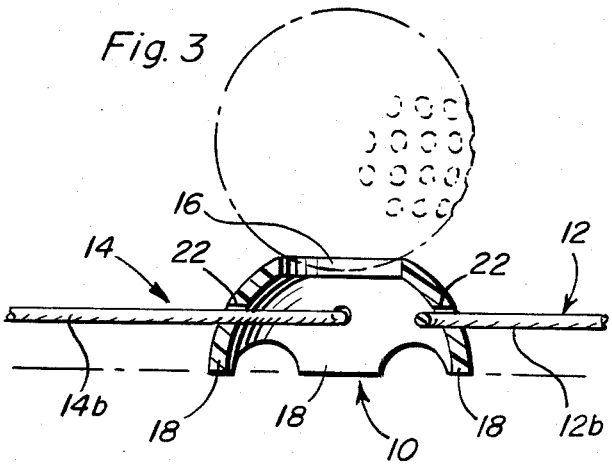
FIG. 3 is a sectional view taken along line 3—3 of FIG. 2.

Referring initially to FIGS. 1 to 3, a golfing aid comprises a tee member 10 of inverted cup-like form, and two cords 12 and 14 integrated with the tee member, as will be described. The tee member may be of molded plastic, for example, and the cords may be of any suitable material, for example Nylon or string.

The tee member is formed with an upper ball supporting opening 16, and recesses along its lower rim defining feet 18 by which it may be supported on a playing surface, generally the ground. The height of the tee member may conveniently be about three quarters of an inch.

Four openings 22 are formed around the body of tee member 10 at 90° spacings, and each of the cords 12 and 14 is wound through an adjacent pair of the openings, in pull-through manner, as shown. (As an alternative, the cords could be wound cross-wise through alternate openings.) The ends of the cords may be knotted or be secured to rings or the like, as indicated at 24 (FIG. 5) to prevent the cords being inadvertently separated from the tee member.

Figure 5:
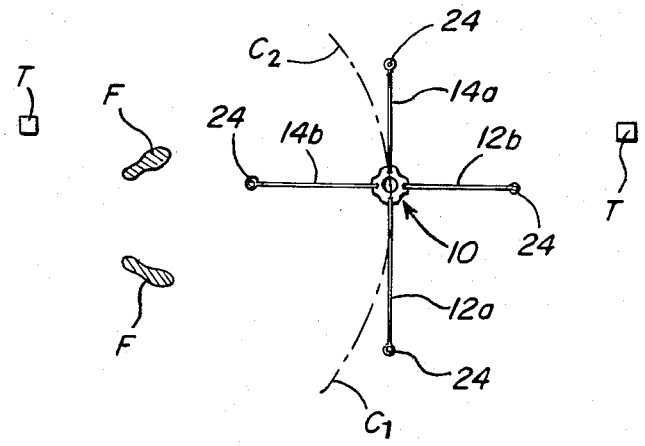
FIG. 5 is a schematic plan view illustrating a manner of using the golfing aid.

The above-described combination allows the cords to be formed into four separate cord lengths **12*a*, 12*b*, 14*a*, 14*b* for extension from the tee member in different directions. In use, the lengths may be laid along the playing surface in a desired orientation to form guides as will be described. Thus, as shown in FIG. 5, for example, the cord lengths are laid in mutually orthogonal alignment. In this example, lengths 12*a* and 14*a* are laid in alignment with an intended line of flight of a proposed shot, length 12*a* being extended behind the tee member, and length 14*a* being extended in front, while lengths 12*b* and 14*b* are laid at right angles to the intended line of flight, length 14*b* extending inwardly from the tee member toward a golfer's feet positions (F), and length 12*b* extending outwardly from the tee member. The dotted line C1 represents a preferred backswing/downswing clubhead swing path, and line C2** represents a preferred follow-through club head swing path. References T represent tee markers.

It will be apparent from the above that cord length **12*a* provides a guide to a golfer assisting the golfer in performing an effective take-away (backswing) while cord length 14*a* provides a clubhead guide for the follow-through. Cord lengths 12*b* and 14*b* provide guides for the golfer for body/feet alignment relative to the intended line of flight, and may also assist in guiding ball position lengthwise relative to the golfer's feet placement. Additionally, cord length 14*b* may serve as a guide to ball position distance-wise from the golfer's feet, so as to assist in obtaining consistent spacing from the ball. The facility for adjusting the length of cord length 14*b*** by use of the pull-through feature, allows the golfer to set different distances from the ball. The cord lengths may be laid at different angles to those shown, to suit different needs.

Figure 4:
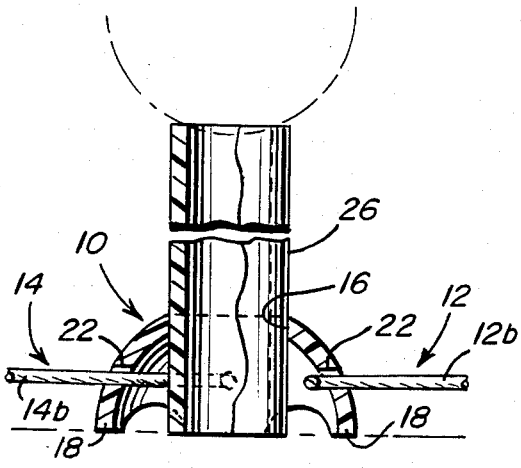
FIG. 4 is an elevational view with portions in section of a modification.

FIG. 4 shows a modified form of the invention wherein a ball-supporting tube 26 is used in conjunction with tee member 10. The tube may also be of plastic and may be a friction fit in opening 16. Provision of tube 26 allows a ball to be teed at different heights. For example, the tube as supplied may be about one and a half inches in length and may be cut to a desired length by the user. A golfer has the option of using member 10 with or without the tube and the tube itself may be raised or lowered in opening 16 to provide further tee-height adjustments.

The invention accordingly provides a golfing aid which combines the functions of a golf ball tee with guide means suitable for the purposes described. Additionally, the tee member may be effective in saving costs of replacement tees, and in reducing the effort involved in placing the tees in hard ground as compared with regular style pointed tees. Further, the aid is simple to recover after a shot, is compact to transport, and simple to set up for use.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A golfing aid comprising a tee member for supporting a golf ball above a playing surface on which the tee member is positioned, and means associated with the tee member for laying along the playing surface in extended relation from the tee member and in predetermined orientation relative to a proposed line of flight of the ball for providing at least one elongate guide of a group comprising a club head swing path guide, a golfer alignment guide, and a ball position guide wherein the tee member comprises an inverted cup-like member having a ball-supporting opening formed therein and wherein the means associated with the tee member comprises at least one cord, and means integrating said cord with the cup-like member for extension of at least one length of the cord from the cup-like member, the tee member further including a tube mounted with a friction fit in said opening for raising and lowering movement therein to provide an alternative adjustable height golf ball support, wherein the tee member has four circumferentially spaced openings, and the means associated with the tee member comprises a pair of cords, each cord being wound in a pair of the openings in pull-through manner bypassing the tube, so as to provide a pair of cord lengths which may be extended from the tee member at different angles.

* * * * *